US008661591B1

(12) United States Patent
Sonderland

(10) Patent No.: US 8,661,591 B1
(45) Date of Patent: Mar. 4, 2014

(54) SHOULDER PAIN ALLEVIATING MATTRESS ASSEMBLY

(76) Inventor: Travis Sonderland, Shreveport, LA (US)

( * ) Notice: Subject to any disclaimer, the term of this patent is extended or adjusted under 35 U.S.C. 154(b) by 137 days.

(21) Appl. No.: 13/199,784

(22) Filed: Sep. 9, 2011

Related U.S. Application Data

(60) Provisional application No. 61/403,145, filed on Sep. 10, 2010.

(51) Int. Cl.
*A47C 17/00* (2006.01)

(52) U.S. Cl.
USPC ..... 5/733; 5/722

(58) Field of Classification Search
USPC ..... 5/731, 733, 631, 735, 930, 722, 723, 5/937
See application file for complete search history.

(56) References Cited

U.S. PATENT DOCUMENTS

| | | | | | |
|---|---|---|---|---|---|
| 829,481 | A * | 8/1906 | Mitchell | ..... | 5/604 |
| 933,323 | A * | 9/1909 | Mitchell | ..... | 5/611 |
| 1,045,228 | A | 11/1912 | Weltmer | | |
| 1,548,728 | A | 8/1925 | Milam | | |
| 2,373,421 | A | 4/1945 | Schenker | | |
| 3,363,272 | A | 1/1968 | Channon | | |
| 4,051,566 | A * | 10/1977 | Esquivel | ..... | 5/722 |
| 4,665,573 | A | 5/1987 | Fiore | | |
| 4,688,283 | A | 8/1987 | Jacobson et al. | | |
| 5,509,153 | A | 4/1996 | Roschacher | | |
| 6,105,187 | A | 8/2000 | Gnjatovic | | |
| 6,516,481 | B1 * | 2/2003 | Erickson | ..... | 5/723 |
| 6,604,253 | B2 * | 8/2003 | Babbini | ..... | 5/733 |
| 7,698,766 | B2 * | 4/2010 | Schultz | ..... | 5/733 |
| 2011/0145995 | A1 * | 6/2011 | Le | ..... | 5/722 |
| 2012/0137444 | A1 * | 6/2012 | Wong | ..... | 5/722 |

* cited by examiner

*Primary Examiner* — Robert G Santos
*Assistant Examiner* — Myles Throop
(74) *Attorney, Agent, or Firm* — R. Keith Harrison

(57) ABSTRACT

A shoulder pain alleviating mattress assembly includes a mattress assembly frame, a foot mattress portion carried by the mattress assembly frame, a head mattress portion carried by the mattress assembly frame in spaced-apart relationship to the foot mattress portion and at least one depth-adjustable arm gap between the foot mattress portion and the head mattress portion.

11 Claims, 6 Drawing Sheets

SHOULDER PAIN ALLEVIATING MATTRESS ASSEMBLY

CROSS-REFERENCE TO RELATED APPLICATIONS

This application claims the benefit of U.S. provisional application No. 61/403,145, filed Sep. 10, 2010 and entitled "SHOULDER PAIN ALLEVIATING MATTRESS ASSEMBLY", which provisional application is hereby incorporated by reference in its entirety.

FIELD

The disclosure generally relates to mattresses. More particularly, the disclosure relates to a shoulder pain alleviating mattress assembly which may be configured with an arm gap that accommodates an arm of a user to reduce pressure on the user's shoulder as the user lies on his or her side on the mattress assembly.

BACKGROUND

Conventional beds include a bed frame, a box springs supported by the bed frame and a mattress supported by the box springs. The box springs and the mattress typically have a uniform height or thickness from the head to the foot of the bed. A person who tends to sleep on his or her side sleeps with the left or right shoulder against the mattress. This sleep position, however, may contribute to painful shoulder conditions since the shoulder supports a large portion of the weight of the upper body.

Accordingly, a shoulder pain alleviating mattress assembly which may be configured with an arm gap that accommodates an arm of a user to reduce pressure on the user's shoulder as the user lies on his or her side on the mattress assembly is needed.

SUMMARY

The disclosure generally relates to a shoulder pain alleviating mattress assembly which may be configured with an arm gap that accommodates an arm of a user to reduce pressure on the user's shoulder as the user lies on his or her side on the mattress assembly. An illustrative embodiment of the shoulder pain alleviating mattress assembly includes a mattress assembly frame, a foot mattress portion carried by the mattress assembly frame, a head mattress portion carried by the mattress assembly frame in spaced-apart relationship to the foot mattress portion and at least one depth-adjustable arm gap between the foot mattress portion and the head mattress portion.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 1:
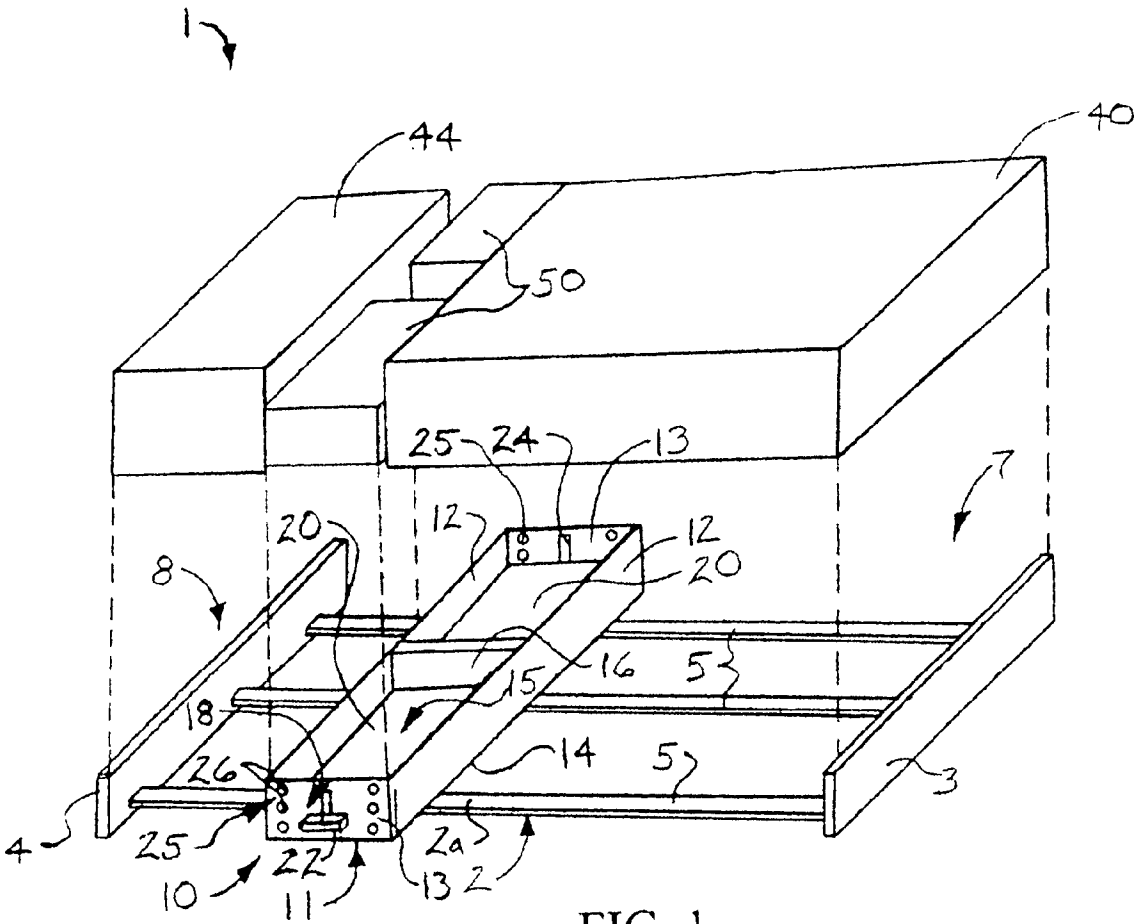
FIG. 1 is an exploded, perspective view of an illustrative embodiment of the shoulder pain alleviating mattress assembly.

Referring initially to FIGS. 1-9 of the drawings, an illustrative embodiment of the shoulder pain alleviating mattress assembly, hereinafter mattress assembly, is generally indicated by reference numeral 1. The mattress assembly 1 may include a generally elongated assembly frame 2. In some embodiments, the assembly frame 2 may have a foot frame member 3 and a head frame member 4 which may be oriented in generally parallel, spaced-apart relationship with respect to each other at respective foot and head ends of the mattress assembly 1. At least one connecting frame member 5 may connect the foot frame member 3 and the head frame member 4. In some embodiments, multiple elongated, parallel, spaced-apart connecting frame members 5 may connect the foot frame member 3 and the head frame member 4, as illustrated in FIG. 1. The foot frame member 3, the head frame member 4 and the connecting frame members 5 of the assembly frame 2 may be metal, wood and/or other sufficiently strong and rigid material which is suitable for the purpose. A frame midpoint 2*a* (FIG. 1) of the assembly frame 2 may be midway between the foot frame member 3 and the head frame member 4.

An arm gap adjustment assembly 10 may be provided on the assembly frame 2. The arm gap adjustment assembly 10 may include a generally elongated assembly enclosure 11 which may be supported by the connecting frame members 5 and oriented in generally transverse relationship with respect to the longitudinal axis of the assembly frame 2. The assembly enclosure 11 may be located generally between the head frame member 4 and the frame midpoint 2*a* (FIG. 1) of the mattress assembly frame 2. In some embodiments, the arm gap adjustment assembly 10 may include a pair of generally elongated, parallel, spaced-apart enclosure sides 12; a pair of enclosure ends 13 connecting respective ends of the enclosure sides 12; an enclosure bottom 14 from which the enclosure sides 12 and the enclosure ends 13 extend; and an enclosure interior 15 defined by the enclosure sides 12, the enclosure ends 13 and the enclosure bottom 14. In some embodiments, an enclosure partition 16 may extend between the enclosure sides 12 in the enclosure interior 15. The enclosure partition 16 may be located generally midway between the enclosure ends 13 of the assembly enclosure 11.

At least one mattress support platform 20 may be provided in the enclosure interior 15 of the assembly enclosure 11. In some embodiments, a pair of mattress support platforms 20 may be provided in the enclosure interior 15 on respective sides of the enclosure partition 16. The heights of the mattress support platforms 20 in the enclosure interior 15 may be independently height-adjustable as will be hereinafter described. At least one platform adjusting mechanism 18 may operably engage each mattress support platform 20 to facilitate selective adjustment of the height of the mattress support platform 20 in the enclosure interior 15. The platform adjusting mechanism 18 may have any design which is suitable for the purpose. In some embodiments, a platform adjustment lever 22 may engage each mattress support platform 20. The platform adjustment lever 22 may extend through a vertical platform adjustment lever slot 24 which is provided in at least one enclosure end 13 of the assembly enclosure 11. In embodiments in which a pair of mattress support platforms 20 is provided in the enclosure interior 15, a pair of platform adjustment levers 22 may extend from the respective mattress adjustment platforms 20 through respective platform adjustment slots 24 in the respective enclosure ends 13 of the assembly enclosure 11. At least one coiled mattress support spring 21 (FIGS. 2 and 4) may be interposed between the enclosure bottom 14 of the assembly enclosure 11 and the lower surface of each mattress support platform 20. In some embodiments, multiple mattress support springs 21 may be interposed between the enclosure bottom 14 and each mattress support platform 20, as illustrated. Accordingly, the mattress support springs 21 normally maintain each mattress support platform 20 in a raised or elevated position in the enclosure interior 15 of the assembly enclosure 11. Each mattress support platform 20 can be selectively lowered in the enclosure interior 15 by pushing the corresponding platform adjustment lever 22 downwardly in the platform adjustment lever slot 24 against the upward bias which is imparted by the mattress support springs 21. It will be recognized and understood that the platform adjusting mechanism 18 which was heretofore described is exemplary only and that any platform adjusting mechanism which is suitable for the purpose of selectively raising or lowering the mattress support platform 20 in the enclosure interior 15 may be used for the purpose. Accordingly, in some embodiments the platform adjusting mechanism 18 may include a motor (not illustrated) which operably engages the mattress support platform 20 and can be operated to selectively raise and lower the mattress support platform 20 in the enclosure interior 15 of the assembly enclosure 11 according to the knowledge of those skilled in the art.

Figures 5, 6, 7, 8, 9:
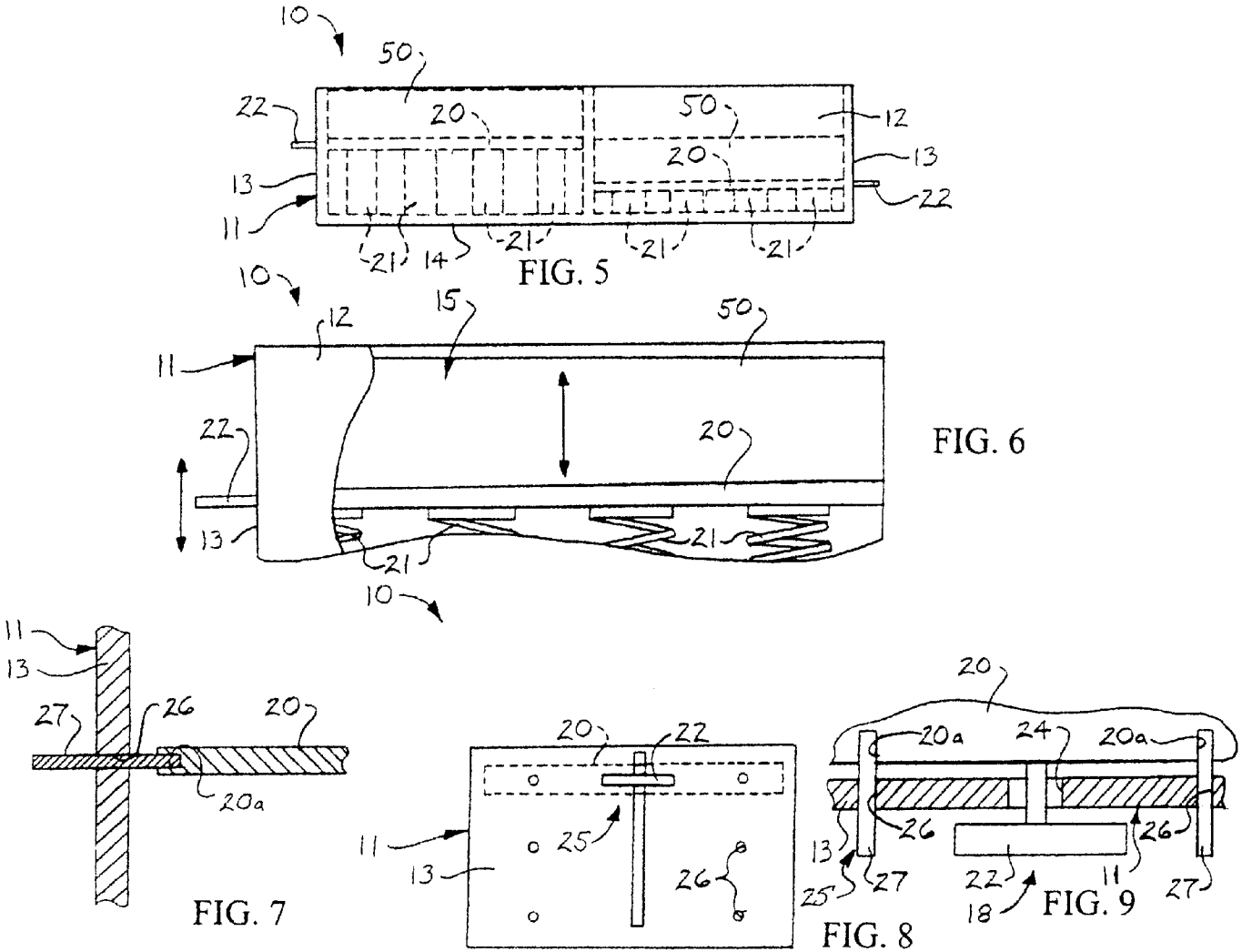
FIG. 5 is a side view of the arm gap adjustment assembly, more particularly illustrating a pair of adjacent mattress support platforms (illustrated in phantom) positioned at selected heights.
FIG. 6 is an enlarged sectional view of the arm gap adjustment assembly, more particularly illustrating vertical adjustment capability of a mattress support platform.
FIG. 7 is a cross-sectional view illustrating an exemplary pin technique for supporting the mattress support platform of the arm gap adjustment assembly at a selected height.
FIG. 8 is an end view of the arm gap adjustment assembly.
FIG. 9 is a sectional view illustrating a platform adjustment lever engaging the mattress support platform and a pair of platform adjustment pins engaging the mattress support platform to secure the mattress support platform at a selected height.

A platform locking mechanism 25 may be adapted to engage each mattress support platform 20 and secure the mattress support platform 20 at a selected height within the enclosure interior 15 of the assembly enclosure 11 against the upward bias which the mattress support springs 21 exert against the mattress support platform 20 for purposes which will be hereinafter described. The platform locking mechanism 25 may have any design which is suitable for the purpose. In some embodiments, at least on set of multiple, vertically spaced-apart platform locking pin openings 26 may extend through each enclosure end 13 of the assembly enclosure 11. In some embodiments, two sets of platform locking pin openings 26 may extend through each enclosure end 12 on respective sides of the platform adjustment lever slot 24, as illustrated in FIG. 8. As illustrated in FIG. 7, at least one support platform pin opening 20*a* may extend into an edge of each mattress support platform 20. As illustrated in FIG. 9, in some embodiments a pair of spaced-apart support platform pin openings 20*a* may extend into each mattress support platform 20. Each support platform pin opening 20*a* in the mattress support platform 20 may register with each corresponding set of platform locking pin openings 26 in the enclosure end 13 of the assembly enclosure 11 the mattress support platform 20 is adjusted vertically in the enclosure interior 15. Accordingly, a platform locking pin 27 may be inserted through a selected one of the platform locking pin openings 26 in the enclosure end 13 and into the registering support platform pin opening 20*a* in the mattress support platform 20, as further illustrated in FIGS. 7 and 9, to secure the mattress support platform 20 at the selected height it the enclosure interior 15 against the upward bias imparted by the mattress support spring or springs 21. Each mattress support platform 20 may be selectively unsecured for vertical adjustment in the enclosure interior 15 by removing the platform locking pin or pins 27 from the support platform pin opening or openings 20*a* in the mattress support platform 20 and the registering platform locking pin opening or openings 26 in the enclosure end 13 of the assembly enclosure 11. The platform adjustment lever 22 may be selectively raised or lowered in the corresponding platform adjustment lever slot 24 to re-adjust the mattress support platform 20 to the desired height in the enclosure interior 15 in an unhindered manner for purposes which will be hereinafter described. It will be recognized and understood that the platform locking mechanism 25 which was heretofore described is exemplary only and that any platform locking mechanism 25 which is suitable for the purpose of selectively locking or securing the mattress support platform 20 at a selected height in the enclosure interior 15 may be used for the purpose.

As illustrated in FIG. 1, a foot mattress space 7 may be defined by and between the foot frame member 3 of the mattress assembly frame 2 and the assembly enclosure 11 of the arm gap adjustment assembly 10. A head mattress space 8 may be defined by and between the head frame member 4 of the mattress assembly frame 2 and the assembly enclosure 11 of the arm gap adjustment assembly 10. The foot mattress space 7 may be sized and configured to receive a foot mattress portion 40. The head mattress space 8 may be sized and configured to receive a head mattress portion 44. The foot mattress portion 40 and the head mattress portion 44 may have any conventional mattress design which is known by those skilled in the art.

Figure 1A:
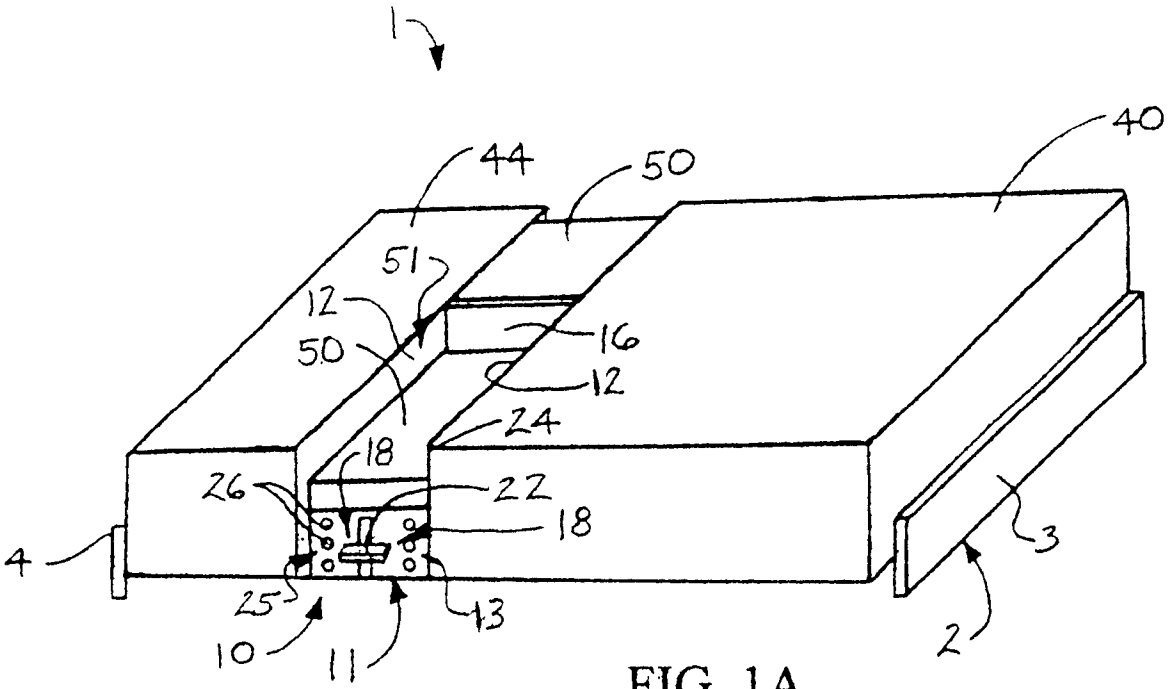
FIG. 1A is a perspective view of an illustrative embodiment of the shoulder pain alleviating mattress assembly.
Figure 2:
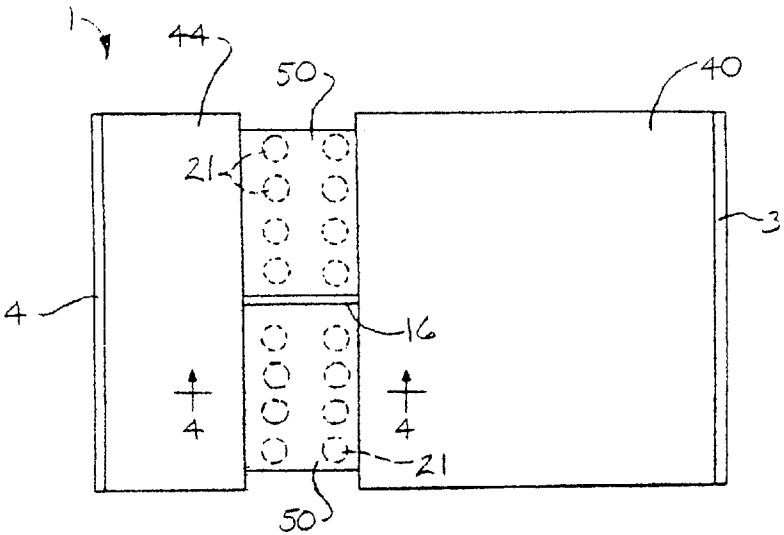
FIG. 2 is a top view of an illustrative embodiment of the shoulder pain alleviating mattress assembly.

As further illustrated in FIG. 1, the enclosure interior 15 in the assembly enclosure 11 of the arm gap adjustment assembly 10 may be sized and configured to receive at least one adjustable mattress portion 50 which is supported by the mattress support platform or platforms 20. In some embodiments, a pair of mattress support platforms 20 may be placed in the assembly enclosure 11 on respective sides of the enclosure partition 16. Accordingly, the height or vertical position of each adjustable mattress portion 50 in the enclosure interior 15 may be selected by adjusting the vertical position of the mattress support platform 20 typically by manipulation of the platform adjustment lever 22 in the platform adjustment lever slot 24 as was heretofore described. As illustrated in FIG. 1A, an arm gap 51 may be defined by and between the assembly enclosure sides 12; the enclosure end 13; and the enclosure partition 16 of the assembly enclosure 11; and by the upper surface of the adjustable mattress portion 50. The depth of the arm gap 51 may be selected by vertical adjustment of the mattress support platform 20 (FIG. 1) and the adjustable mattress portion 50 which is supported thereon in the assembly enclosure 11, typically as was heretofore described, for purposes which will be hereinafter described. In some embodiments, each adjustable mattress portion 50 may have a conventional mattress design which is well-known by those skilled in the art. In other embodiments, each adjustable mattress portion 50 may have a foam, feather or other pillow design.

Figure 3:
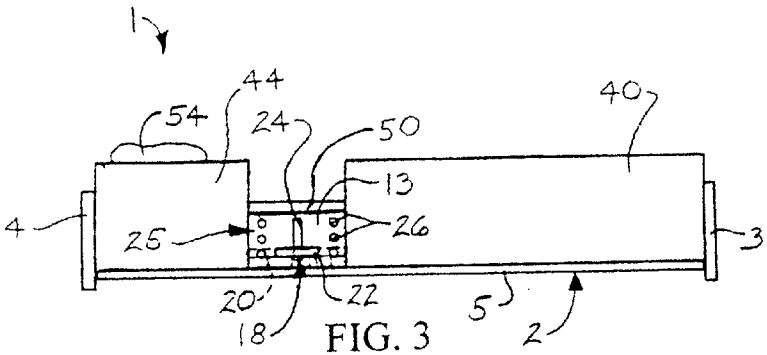
FIG. 3 is a side view of an illustrative embodiment of the shoulder pain alleviating mattress assembly.
Figure 4:
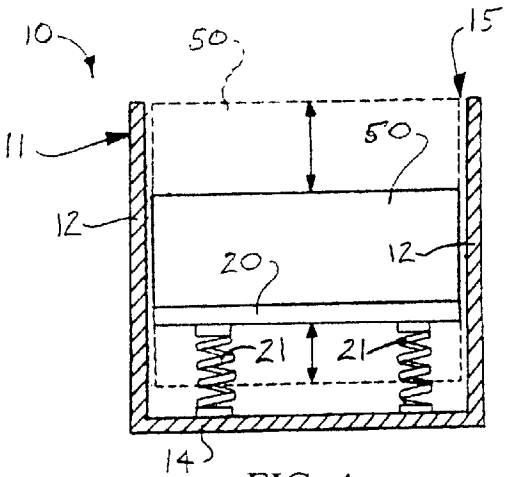
FIG. 4 is a cross-sectional view, taken along section lines 4-4 in FIG. 2, of an arm gap adjustment assembly of an illustrative embodiment of the shoulder pain alleviating mattress assembly.

In exemplary application of the mattress assembly 1, the mattress assembly frame 2 may be placed on a floor or other support surface (not illustrated). In some embodiments, a box springs (not illustrated), which may be conventional, may be placed on the floor or other support surface and the mattress assembly frame 2 may be placed on the box springs. At least one user (not illustrated) reclines on the mattress assembly 1 with the user's legs and lower body positioned on the foot mattress portion 40 and the user's head positioned on the head mattress portion 44. As illustrated in FIG. 3, at least one pillow 54 may be placed on the head mattress portion 44 for supporting the user's head. In some applications, conventional bedding (not illustrated) such as a fitted sheet, a top sheet, blankets and a bedspread, for example and without limitation, may be additionally placed on the mattress assembly 1 typically in the conventional manner. In the event that a user prefers to eliminate the arm gap 51 between the foot mattress portion 40 and the head mattress portion 44, the height of the mattress support platform 20 and the adjustable mattress portion 50 supported thereon may be selected such that the adjustable mattress portion 50 is positioned at substantially the same height as the foot mattress portion 40 and the head mattress portion 44. Therefore, in the event that the user lies on his or her shoulder, the shoulder may rest on the adjustable mattress portion 50.

In some applications, at least one of the mattress support platforms 20 (FIG. 1) and the adjustable mattress portion 50 which is supported thereon may be adjusted vertically in the assembly enclosure 11 by operation of the platform adjusting mechanism 18 to form the arm gap 51 between the foot mattress portion 40 and the head mattress portion 44. Accordingly, the user may extend his or her left or right arm into the arm gap 51 to alleviate weight or pressure from the user's upper body which would otherwise be applied by the corresponding shoulder against the adjustable mattress portion 50. In some users, this may substantially eliminate or reduce shoulder pain associated with the user's sleeping on his or her shoulder. It will be appreciated by those skilled in the art that the depth of the arm gap 51 may be selectively adjusted according to the preferences of the user typically by disengaging the platform locking pin or pins 27 from the respective support platform pin openings 20*a* and platform locking pin openings 26, raising or lowering the mattress support platform 20 in the enclosure interior 15 of the assembly enclosure 11 and re-inserting the platform locking pin or pins 27 into the locking pin opening or openings 26 and registering support platform pin opening or openings 20*a* in the mattress support platform 20, as was heretofore described.

In some embodiments, the mattress assembly 1 may be sized to accommodate two adjacent users with two adjacent and independently-adjustable mattress support platforms 20 and adjustable mattress portions 50. Accordingly, it will be appreciated by those skilled in the art that in those embodiments, the height or position of each adjustable mattress portion 50 in the assembly enclosure 11 may be selected to vary the depth of each arm gap 51 according to the preferences of each individual user.

Figure 10:
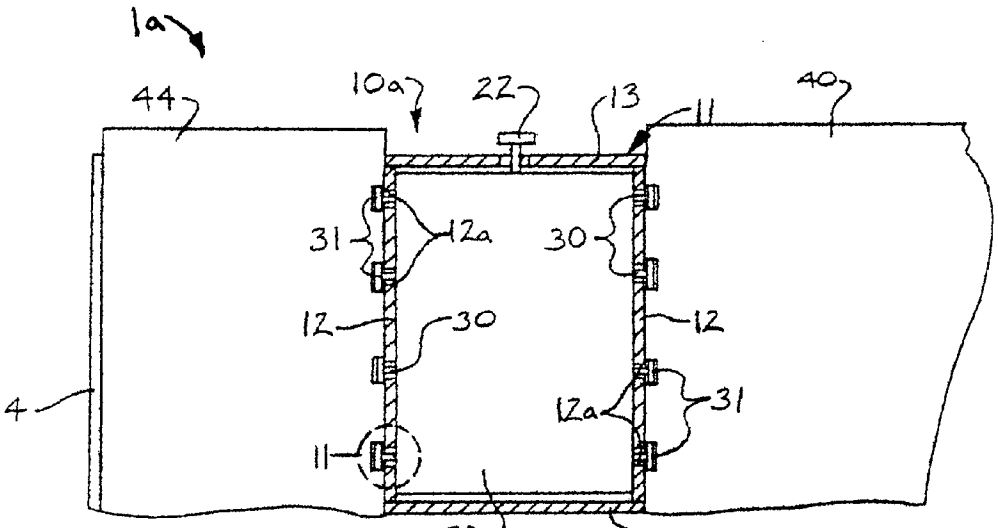
FIG. 10 is a top view, partially in section, of an alternative illustrative embodiment of the shoulder pain alleviating mattress assembly.
Figure 12:
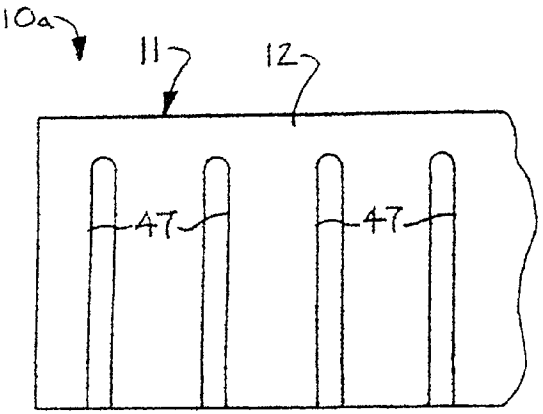
FIG. 12 is a side view of a portion of the shoulder gap adjustment assembly of the shoulder pain alleviating mattress assembly illustrated in FIG. 10.
Figure 11:
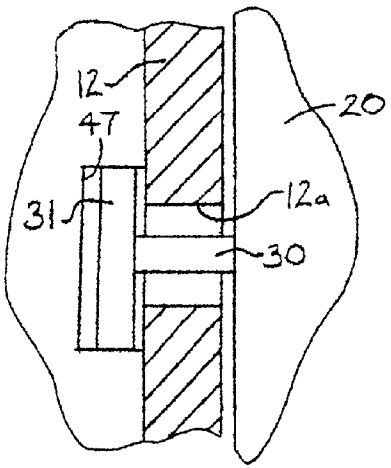
FIG. 11 is an enlarged sectional view, taken along section line 11 in FIG. 10, illustrating a platform guide wheel extending from the mattress support platform (in section) and engaging a guide wheel slot provided in the head mattress portion of the shoulder pain alleviating mattress assembly illustrated in FIG. 10.

Referring next to FIGS. 10-12 of the drawings, in some embodiments of the assembly (generally indicated by reference numeral 1*a*) multiple, spaced-apart wheel shaft openings 12*a* may extend through each enclosure side 12 of the assembly enclosure 11. Guide wheel slots 47 (FIG. 11) may be provided in each of the foot mattress portion 40 and the head mattress portion 44 in communicating relationship with respect to the respective wheel shaft openings 12*a*. Multiple wheel shafts 30 may extend from each edge of each mattress support platform 20 through the respective wheel shaft openings 12*a* and into the respective guide wheel slots 47. Platform guide wheels 31 may be provided on the respective wheel shafts 30 in the respective guide wheel slots 47. Accordingly, the guide wheels 31 may engage the interior surfaces of the respective guide wheel slots 47 to guide or stabilize the mattress support platform 20 as the vertical position of the mattress support platform 20 is adjusted in the enclosure interior 15 of the assembly enclosure 11 typically as was heretofore described with respect to the assembly 1 in FIGS. 1-9.

Figure 13:
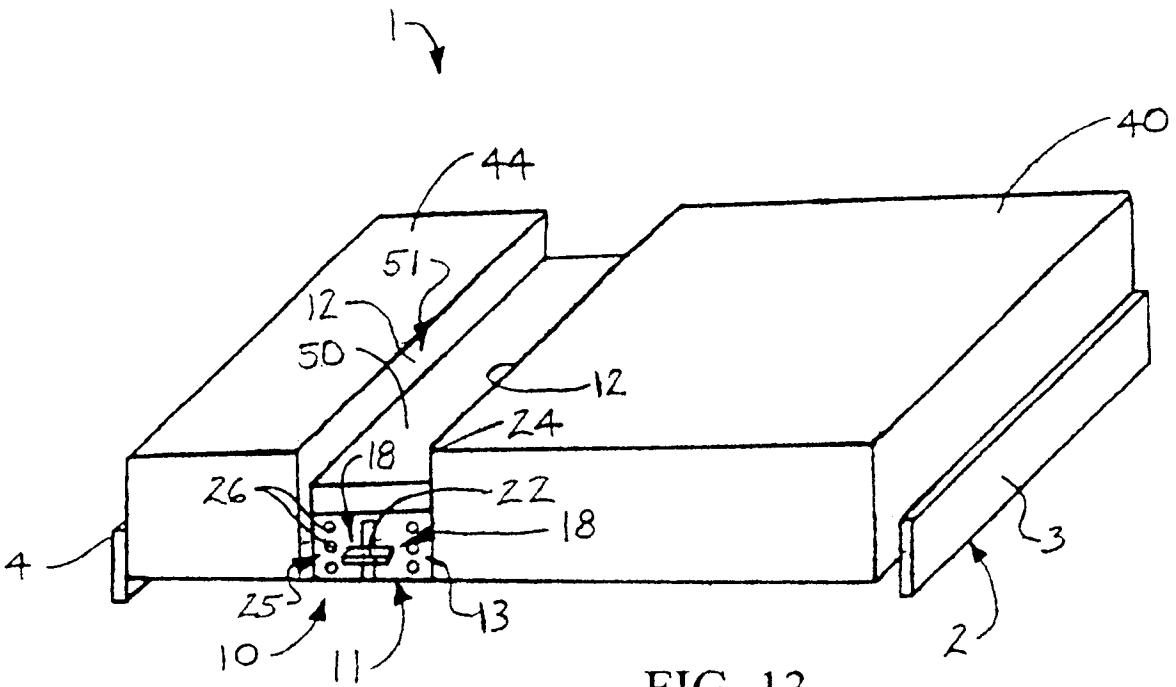
FIG. 13 is a perspective view of an alternative illustrative embodiment of the shoulder pain alleviating mattress assembly.

Referring next to FIG. 13 of the drawings, an alternative illustrative embodiment of the shoulder pain alleviating mattress assembly is generally indicated by reference numeral 1*b*. The mattress assembly 1*b* may have a design which is similar to the mattress assembly 1 which was heretofore described with respect to FIGS. 1 and 1A, in which like reference numerals in the mattress assembly 1*b* of FIG. 13 designate elements which correspond to the respective elements in the mattress assembly 1 of FIGS. 1A and 1B. In the mattress assembly 1*b*, the enclosure partition 16 (FIGS. 1 and 1A) may be omitted from the assembly enclosure 11. Accordingly, a single, elongated, continuous mattress support platform 20 (FIG. 1) may be provided in the enclosure interior 15 of the assembly enclosure 11. A single, elongated, continuous adjustable mattress portion 50 may be supported by the mattress support platform 20. A platform adjusting mechanism 18 and platform locking mechanism 25 may be provided at one or both ends of the assembly enclosure 11.

Application of the mattress assembly 1*b* may be as was heretofore described with respect to the mattress assembly 1 in FIGS. 1 and 1A. In the mattress assembly 1*b*, the arm gap 51 may be continuous between the enclosure ends 13 of the assembly enclosure 11. This expedient provides free and unhindered placement of a user's arm (not illustrated) in the arm gap 51 as the user lies on the foot mattress portion 40 and the head mattress portion 44.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A shoulder pain alleviating mattress assembly, comprising:

a mattress assembly frame;

a foot mattress portion carried by said mattress assembly frame;

a head mattress portion carried by said mattress assembly frame in spaced-apart relationship to said foot mattress portion;

an arm gap adjustment assembly having an assembly enclosure carried by said mattress assembly frame between said foot mattress portion and said head mattress portion, at least one height-adjustable mattress support platform in said assembly enclosure and at least one adjustable mattress portion carried by said at least one mattress support platform; and a platform locking mechanism including a plurality of platform locking pin openings in the assembly enclosure and a platform locking pin extending through one of the plurality of platform locking pin openings and engaging the at least one height-adjustable mattress support platform.

2. The shoulder pain alleviating mattress assembly of claim 1 wherein said at least one adjustable mattress portion comprises a single continuous adjustable mattress portion.

3. The shoulder pain alleviating mattress assembly of claim 1 wherein said at least one adjustable mattress portion comprises a pair of adjustable mattress portions.

4. The shoulder pain alleviating mattress assembly of claim 1 further comprising a platform adjusting mechanism engaging said at least one height-adjustable mattress support platform.

5. The shoulder pain alleviating mattress assembly of claim 4 further comprising at least one mattress support spring engaging said at least one height-adjustable mattress support platform.

6. The shoulder pain alleviating mattress assembly of claim 1 wherein said mattress assembly frame comprises a foot frame member, a head frame member spaced-apart from said foot frame member and at least one connecting frame member extending between said foot frame member and said head frame member.

7. A shoulder pain alleviating mattress assembly, comprising:

a generally elongated mattress assembly frame having a longitudinal mattress assembly frame axis;

a foot mattress portion carried by said mattress assembly frame;

a head mattress portion carried by said mattress assembly frame in spaced-apart relationship to said foot mattress portion; and an arm gap adjustment assembly including:

a generally elongated assembly enclosure having an enclosure interior carried by said mattress assembly frame between said foot mattress portion and said head mattress portion and in transverse relationship to said longitudinal mattress assembly frame axis;

at least one mattress support spring in said assembly enclosure;

at least one height-adjustable mattress support platform carried by said at least one mattress support spring in said assembly enclosure;

at least one adjustable mattress portion carried by said at least one height-adjustable mattress support platform;

a platform adjusting mechanism engaging said at least one height-adjustable mattress support platform, said platform adjusting mechanism having:

at least one platform adjustment lever slot in the assembly enclosure; and at least one platform adjustment lever extending through the platform adjustment lever slot and engaging the at least one mattress support platform; and a platform locking mechanism engaging said at least one height-adjustable mattress support platform, said platform locking mechanism having:

a plurality of platform locking pin openings in the assembly enclosure; and a platform locking pin extending through one of the plurality of platform locking pin openings and engaging the at least one height-adjustable mattress support platform.

8. The shoulder pain alleviating mattress assembly of claim 7 further comprising an enclosure partition dividing said enclosure interior of said assembly enclosure and wherein said at least one height-adjustable mattress support platform comprises a pair of height-adjustable mattress support platforms on respective sides of said enclosure partition and said at least one adjustable mattress portion comprises a pair of adjustable mattress portions carried by said pair of height-adjustable mattress support platforms, respectively.

9. The shoulder pain alleviating mattress assembly of claim 7 wherein said at least one height-adjustable mattress support platform comprises a single, elongated, continuous mattress support platform and said at least one adjustable mattress portion comprises a single, elongated, continuous adjustable mattress portion carried by said height-adjustable mattress support platform.

10. The shoulder pain alleviating mattress assembly of claim 7 wherein said assembly enclosure of said arm gap adjustment assembly comprises an enclosure bottom; a pair of generally elongated, parallel, spaced-apart enclosure sides carried by said enclosure bottom; a pair of spaced-apart enclosure ends carried by said enclosure bottom and extending between said enclosure sides; and an enclosure interior defined by and between said enclosure bottom, said enclosure sides and said enclosure ends.

11. The shoulder pain alleviating mattress assembly of claim 7 wherein said mattress assembly frame comprises a foot frame member, a head frame member spaced-apart from said foot frame member and at least one connecting frame member extending between said foot frame member and said head frame member.

* * * * *